United States Patent [19]

Dorazio et al.

[11] Patent Number: 4,466,482

[45] Date of Patent: Aug. 21, 1984

[54] TRIPLE PASS CERAMIC HEAT RECUPERATOR

[75] Inventors: Raymond E. Dorazio, Wysox; William L. Mingos, East Smithfield; Joseph J. Cleveland, Towanda, all of Pa.

[73] Assignee: GTE Products Corporation, Stamford, Conn.

[21] Appl. No.: 325,415

[22] Filed: Nov. 27, 1981

[51] Int. Cl.[3] ..... F28F 9/22

[52] U.S. Cl. ..... 165/145; 165/165; 165/137; 165/174

[58] Field of Search ..... 165/80, 81, 82, 76, 165/164, 166, 167, 165, 174, 137, 145, 170, 176

[56] References Cited

U.S. PATENT DOCUMENTS

| | | | |
|---|---|---|---|
| 1,823,788 | 9/1931 | Dewoitine et al. | 165/166 |
| 2,828,947 | 4/1958 | Hedbom | 165/166 |
| 3,256,930 | 6/1966 | Norback | 165/166 |
| 3,334,399 | 8/1967 | Teeguarden | 165/166 |
| 4,168,737 | 9/1979 | Yoshimitsu | 165/165 |
| 4,279,297 | 7/1981 | Dziedzic | 165/165 |
| 4,300,627 | 11/1981 | Cleveland | 165/165 |

*Primary Examiner*—William R. Cline
*Assistant Examiner*—John F. McNally
*Attorney, Agent, or Firm*—James Theodosopoulos

[57] ABSTRACT

A heat recuperator comprises a cross-flow ceramic core within a housing. The housing includes an inlet conduit and an outlet conduit for a gas to be heated. The housing also includes means for thrice passing said gas through the ceramic core in order to improve the diffusion of the gas through the core.

5 Claims, 2 Drawing Figures

TRIPLE PASS CERAMIC HEAT RECUPERATOR

This invention concerns ceramic cross-flow heat recuperators. Such recuperators comprise a ceramic heat-exchanger core within a suitable housing and are shown in U.S. Pat. Nos. 3,948,317, 4,083,400, 4,130,160, 4,262,740, 4,279,297 and 4,300,627. The recuperators disclosed therein are either single-pass or double-pass, but the gas to be heated, usually air for combustion, is single-pass through the ceramic core. A problem can arise when combustion air is only singly passed through the ceramic core. There can be poor diffusion of the cool combustion air throughout the ceramic core with the result that, during operation, there can be substantially unequal cooling of the core. The resulting thermal gradient throughout the core can shorten the life thereof.

This invention is concerned with improving the diffusion of the combustion air through the ceramic core in order to minimize thermal gradients. This is accomplished by placing suitable inserts in the recuperator so that the combustion air passes thrice through the ceramic core. The diffusion is improved because the cross sectional area of the core through which the combustion air flows is reduced to about one-third of that when the combustion air singly passes through the core.

Figure 1:
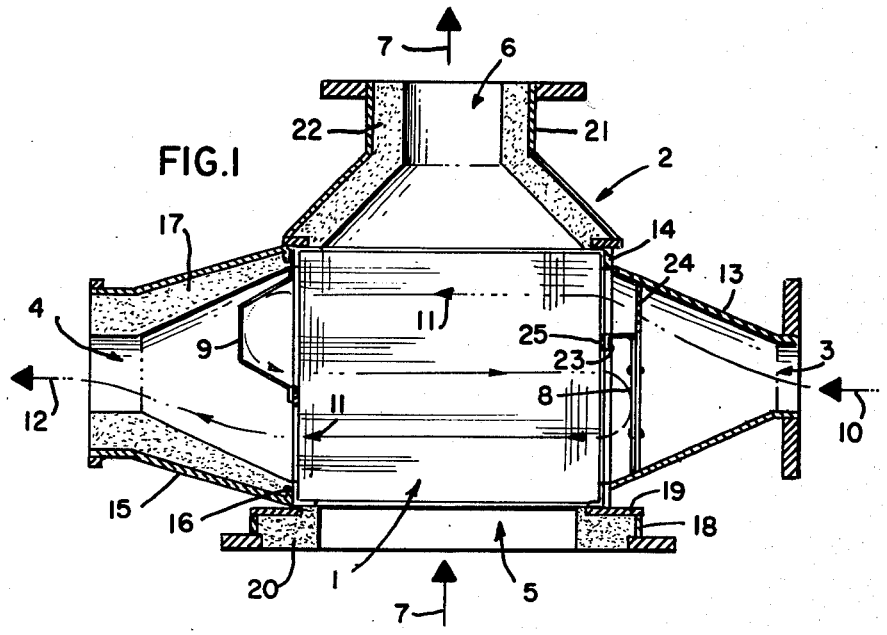
FIG. 1 is a sectional view of a recuperator in accordance with this invention, showing the inserts that convert the recuperator from single pass to triple pass.

In one embodiment of a recuperator in accordance with this invention, as shown in the drawing, ceramic core 1 is contained within a housing 2. The combustion air enters at inlet 3 and exits at outlet 4. The hot exhaust gases enter at inlet 5, pass through core 1 in a single pass, and exit at outlet 6. Their path is shown by arrows 7.

Ordinarily the combustion air would pass through core 1 in a single pass. However, with first insert 8 and second insert 9 in place, the combustion air path is converted to triple pass, following the path of arrow 10 at the inlet, arrows 11 within the core, and arrow 12 at the outlet.

In a specific example, housing 2 was made up of flanged metal conduits. Tapered conduit 13 which served as the inlet for incoming combustion air, was attached to rectangular metal flange 14 which was held in firm contact with the respective face of core 1 (with a suitable gasket therebetween), as shown in U.S. Pat. No. 4,300,627. Tapered conduit 15, which served as the outlet for the heated combustion air, was similarly attached to rectangular metal flange 16 which was similarly attached to rectangular metal flange 16 which was similarly held in gasket contact with the respective face of core 1. Because conduit 15 can be exposed to high temperatures from the heated combustion air, it can be lined with a ceramic insulating layer 17.

Inlet conduit 18 for the hot exhaust gases was similarly attached to rectangular metal flange 19 which was similarly held in gasket contact with the respective face of core 1. Conduit 18 was also lined with a ceramic insulating layer 20. Exhaust conduit 21 for the hot exhaust gases was similarly attached and similarly lined with ceramic insulating layer 22.

First insert 8, for a ceramic core that was a one foot cube, was made from a 60 mil thick stainless steel sheet that measured 9 15/16″×9⅝″. The sheet was bent 90° on a line ⅝″ back from one end and then bent 90° again on a line about 1¾″ back from said end. This provided the L shape shown in FIG. 2 with a narrow ⅝″ wide leg 23 that was parallely spaced about 1⅛″ from the main area of insert 8. Insert 8 was fastened to a perforated metal plate 24 that was fastened within conduit 13. The purpose of perforated metal plate 24 was to aid in diffusing incoming combustion air. Insert 8 was so positioned within conduit 13 that leg 23 was in firm contact with the respective face of ceramic core 1, that is to say, actually in firm contact with gasket 25 therebetween, and the flow of incoming combustion air was diverted to the upper third of ceramic core 1.

Figure 2:
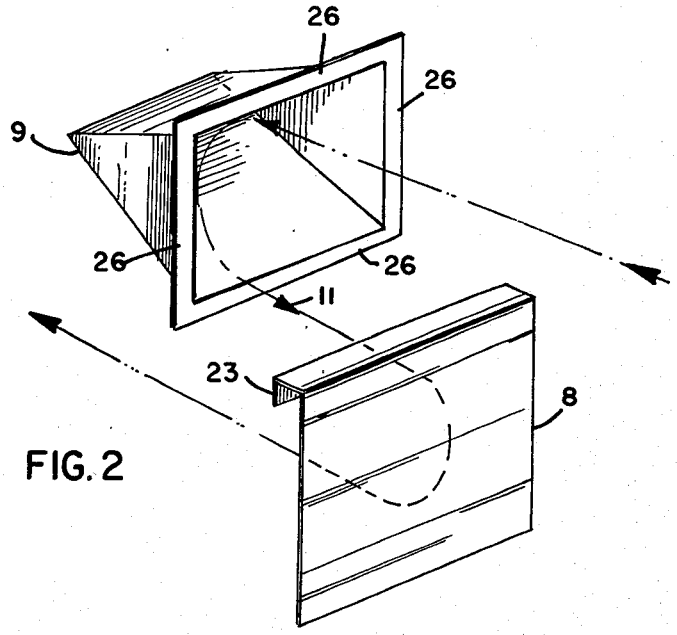
FIG. 2 is a perspective view of the inserts.

Second insert 9 was also made of stainless steel and was cap shaped, as shown in FIG. 2. Edges 26 were in firm gasket contact with the respective face of ceramic core 1. Three of the four edges 26 of outlet insert 9 were sandwiched between metal flange 16 and the respective face of ceramic core 1, which held insert 9 in place. As the combustion air flowed out of the left face of the upper third of ceramic core 1, insert 9 directed the flow back through the middle third of ceramic core 1, as shown by arrows 11. Then, as the air exited at the right from said middle third, insert 8 directed the flow back through the bottom third of ceramic core 1, as shown by the arrows. The heated combustion air flowed out of recuperator outlet 4.

If desired, each of the three passes of the combustion air through core 1 need not be through a one-third cross sectional area. For example, in a particular case, if the greatest temperature difference between the combustion air and the hot exhaust gasses occurs during the first pass of the combustion air, the cross sectional area for said first pass could be reduced. This could increase the cross sectional area for either or both other passes. In particular cases, the area for each of the three passes could be greater or less than one-third.

We claim:

1. A heat recuperator comprising a cross-flow ceramic core within a housing, the housing including an inlet conduit and an outlet conduit for a gas to be heated, the housing including means for thrice passing said gas through said ceramic core in order to improve the diffusion of said gas through said core, wherein said means includes a first insert within said inlet conduit for directing the flow of said gas through a first portion of the core and a second insert within said outlet conduit for reversing the flow of said gas through the core and redirecting said gas toward said first insert which again reverses the flow of gas through the remaining portion of the core.

2. The recuperator of claim 1 wherein said first insert directs the flow of said gas into an area of about one-third the cross sectional area of said core.

3. The recuperator of claim 2 wherein said first insert is substantially L shaped having a narrow leg, said leg being in firm contact with said ceramic core, but with a gasket therebetween.

4. The recuperator of claim 2 wherein said second insert is cap shaped and directs the flow of said gas from said one-third cross sectional area back into the ceramic core through a different one-third cross sectional area.

5. The recuperator of claim 4 wherein said first insert directs the flow of said gas from said different one-third sectional area back into the ceramic core through the remaining one-third cross sectional area.

* * * * *